United States Patent [19]

Eberly, Jr. et al.

[11] 4,446,005

[45] May 1, 1984

[54] GUARD BED FOR THE REMOVAL OF SULFUR AND NICKEL FROM FEEDS PREVIOUSLY CONTACTED WITH NICKEL CONTAINING SULFUR ADSORPTION CATALYSTS

[75] Inventors: Paul E. Eberly, Jr.; Judeth H. Brannon, both of Baton Rouge, La.

[73] Assignee: Exxon Research and Engineering Co., Florham Park, N.J.

[21] Appl. No.: 419,239

[22] Filed: Sep. 17, 1982

[51] Int. Cl.[3] ..... C10G 25/00

[52] U.S. Cl. ..... 208/91; 208/49; 208/217

[58] Field of Search ..... 208/91, 49, 217

[56] References Cited

U.S. PATENT DOCUMENTS

| | | | |
|---|---|---|---|
| 3,852,165 | 12/1974 | Robson | 208/217 |
| 3,936,371 | 2/1976 | Ueda | 208/217 |
| 4,028,223 | 6/1977 | Hayes et al. | 208/91 |
| 4,225,417 | 9/1980 | Nelson | 208/91 |

*Primary Examiner*—Curtis R. Davis

*Attorney, Agent, or Firm*—Llewellyn A. Proctor

[57] ABSTRACT

A back-end guard bed is located downstream of and in series with a nickel catalyst-containing sulfur trap to remove the organosulfur-nickel complex formed in the nickel catalyst-containing sulfur trap and passed along with the product therefrom during periods of hydrofiner upset, or such other periods when sulfur concentration, flow rate and operating temperature of the feed passed from the hydrofiner through the nickel catalyst-containing sulfur trap forms the organosulfur-nickel complex.

5 Claims, 5 Drawing Figures

Figure 1:
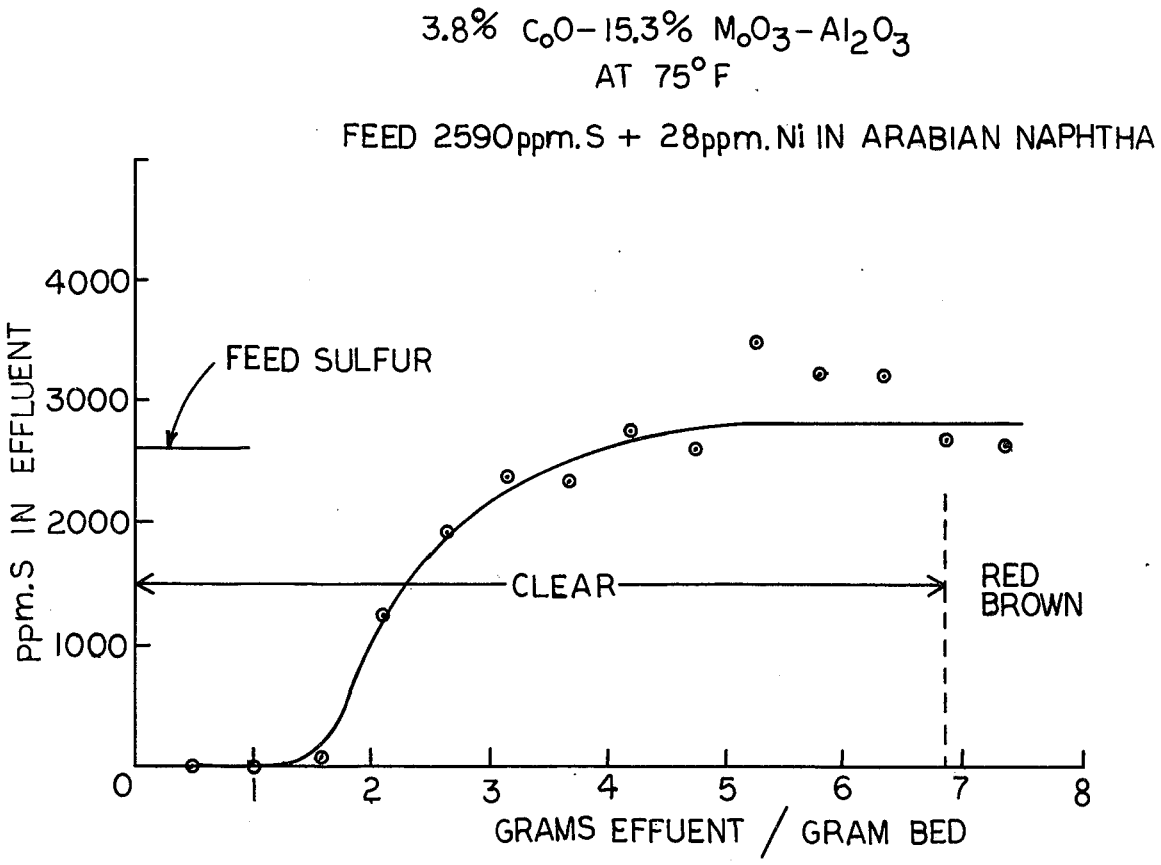

GUARD BED FOR THE REMOVAL OF SULFUR AND NICKEL FROM FEEDS PREVIOUSLY CONTACTED WITH NICKEL CONTAINING SULFUR ADSORPTION CATALYSTS

I. FIELD OF THE INVENTION

This invention relates to a process for the desulfurization of hydrocarbon feedstocks, particularly the removal of sulfur and nickel from naphtha feeds which have been previously contacted with nickel-containing sulfur adsorption catalysts.

II. BACKGROUND OF THE INVENTION AND PRIOR ART

Reforming with hydrogen, or hydroforming, is a well established industrial process employed by the petroleum industry for upgrading virgin or cracked naphthas for the production of high octane gasoline. Reforming is defined as the total effect of the molecular changes, or hydrocarbon reactions produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins to produce gas and coke, the latter being deposited on the catalyst. Historically, noble metal catalysts, notably platinum supported on alumina, have been employed for this reaction. More recently, polymetallic catalysts consisting of platinum-rhenium, platinum-iridium, platinum-tin, or various combinations thereof promoted with any one or more of the following elements copper, selenium, sulfur, chloride, and fluoride, are being utilized.

In a typical process, a series of reactors are provided with fixed beds of catalyst which receive upflow or downflow feed, and each reactor is provided with a preheater or interstage heater, because the desirable reactions which take place are endothermic. A naphtha feed, with hydrogen, or recycle gas, is cocurrently passed through a reheat furnace and reactor, and then in sequence through subsequent heaters and reactors of the series. The vapor effluent from the last reactor of the series is a gas rich in hydrogen, which usually contains small amounts of normally gaseous hydrocarbons, from which hydrogen is separated from the $C_5+$ liquid product and recycled to the process to minimize coke production; coke invariably forming and depositing on the catalyst during the reaction.

Essentially all petroleum naphtha feeds contain sulfur, a well known catalyst poison which can gradually accumulate upon and poison the catalyst. Most of the sulfur, because of this adverse effect, is generally removed from feed naphthas, e.g., by hydrofining with conventional hydrodesulfurization catalysts consisting of the sulfides of cobalt or nickel and molybdenum supported on a high surface area alumina. The severity of hydrofining can be increased so that essentially all the sulfur is removed from the naphtha in the form of $H_2S$. However, small quantities of olefins are also produced. As a consequence, when the exit stream from the hydrofiner is cooled, sulfur can be reincorporated into the naphtha by the combination of $H_2S$ with the olefins to produce mercaptans.

In reforming, sulfur compounds, even at a 1–20 parts per million weight range contribute to loss of catalyst activity and $C_5+$ liquid yield. In the last decade, in particular, polymetallic metal catalysts have been employed to provide, at reforming conditions, improved catalyst activity, selectivity and stability. Thus, additional metallic components have been added to the more conventional platinum catalysts as promotors to further improve, particularly, the activity or selectivity, or both, of the basic platinum catalyst, e.g., iridium, rhenium, selenium, tin, and the like. In the use of these catalysts it has become essential to reduce the feed sulfur to only a few parts per million by weight, wppm. For example, in the use of platinum-rhenium catalysts it is generally necessary to reduce the sulfur concentration of the feed well below about 2 wppm, and preferably well below about 0.1 wppm, to avoid excessive loss of catalyst activity and $C_5+$ liquid yield. By removing virtually the last traces of sulfur from the naphtha feed, catalyst activity and $C_5+$ liquid yield of high octane gasoline can be significantly increased.

The sulfur-containing feed, prior to reforming, is hydrofined over a Group VI-B or Group VIII catalyst, e.g., a Co/Mo catalyst, and a major amount of the sulfur is removed. Residual sulfur is then generally removed from the naphtha feeds by passage through a "sulfur trap." Within the sulfur trap residual sulfur is removed from the naphtha feeds by adsorption over copper chromite, nickel, cobalt, molybdenum, and the like. These and other metals have been found useful per se, or have been supported on high surface area refractory inorganic oxide materials such as alumina, silica, silica/alumina, clays, kieselguhr, and the like. Massive nickel catalysts, or catalysts containing from about 10 percent to about 70 percent nickel, alone or in admixture with other metal components, supported on an inorganic oxide base, notably alumina, have been found particularly effective in removing sulfur from naphtha feeds, notably naphtha feeds containing from about 1 to about 50 ppm sulfur, or higher.

The sulfur trap which contains a nickel catalyst has been found to perform admirably well, both in its ability to effectively remove sulfur from the feed, and over prolonged periods of operation. Albeit the hydrofined feed usually contains from about 1 wppm to about 5 wppm sulfur, it can contain as much as 50 wppm sulfur, and higher, during periods of hydrofiner upset. The sulfur trap containing a nickel catalyst has been found suitable for removing sulfur from the hydrofined feed, lowering the sulfur to a level of 0.1 ppm, and less. The sulfur concentration, flow rate and operating temperature of the feed entering the nickel catalyst-containing sulfur trap, have been found to be critical to the quality of the product output from the sulfur trap. Preferred temperatures lie in the range of 300°–500° F. At temperatures below about 200° F. and sulfur feed concentrations of about 50 ppm, the product from the sulfur trap is often found to contain both nickel and sulfur as an organosulfur nickel complex. The organosulfur nickel complex, which often produces a burgundy or reddish-brown color in the product from the nickel catalyst-containing sulfur trap, is detrimental to polymetallic platinum-containing reforming catalysts. In many refineries, the product from the naphtha hydrofiner has a temperature of 100V–200° F. It is economically desirable to be able to operate the nickel sulfur trap at these temperatures and thus, to eliminate the need for a heat exchanger, it becomes a necessity to provide a means for removing the soluble organosulfur nickel complex from the product.

III. BRIEF DESCRIPTION OF DRAWINGS

Figure 2:
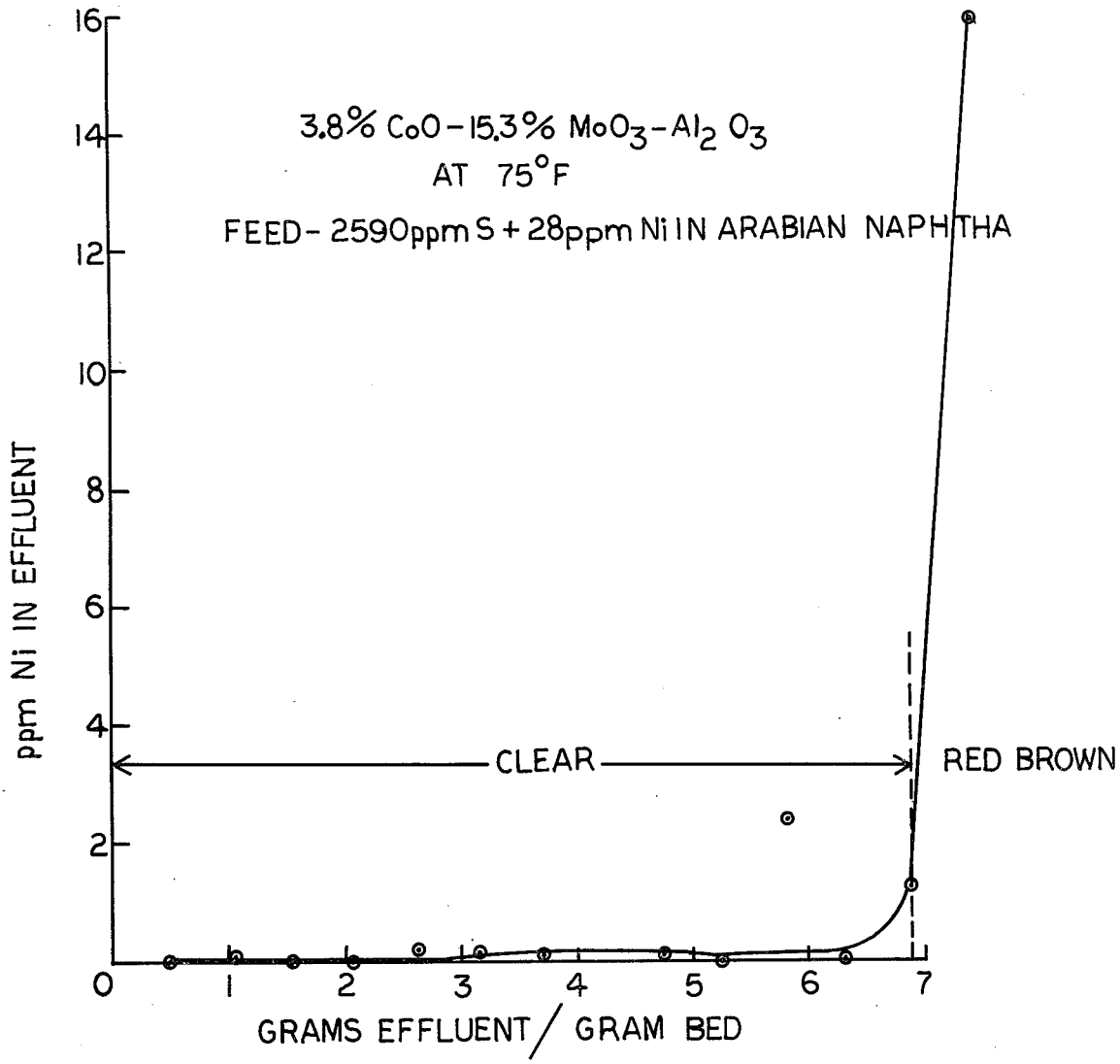
Figure 3:
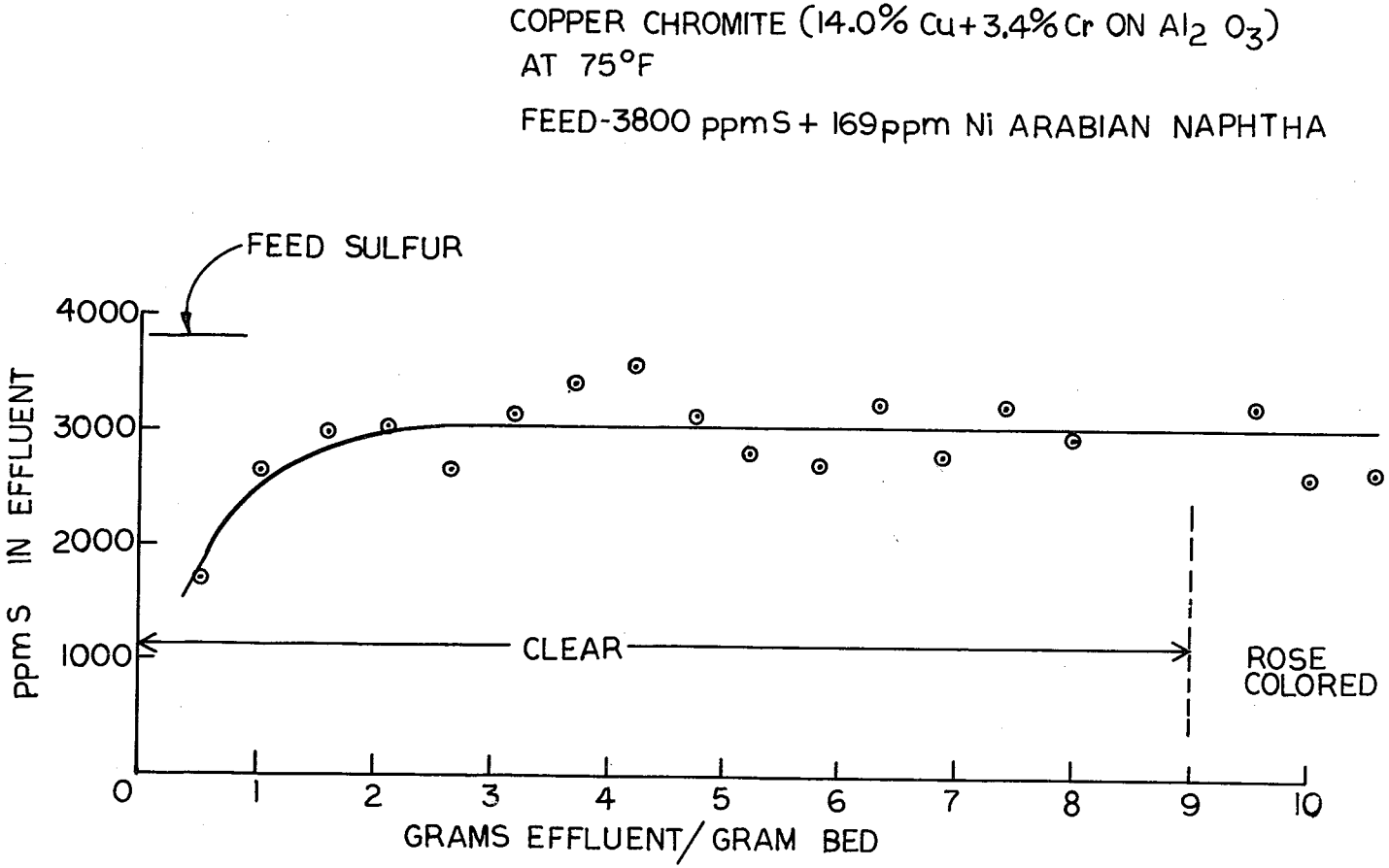
Figure 4:
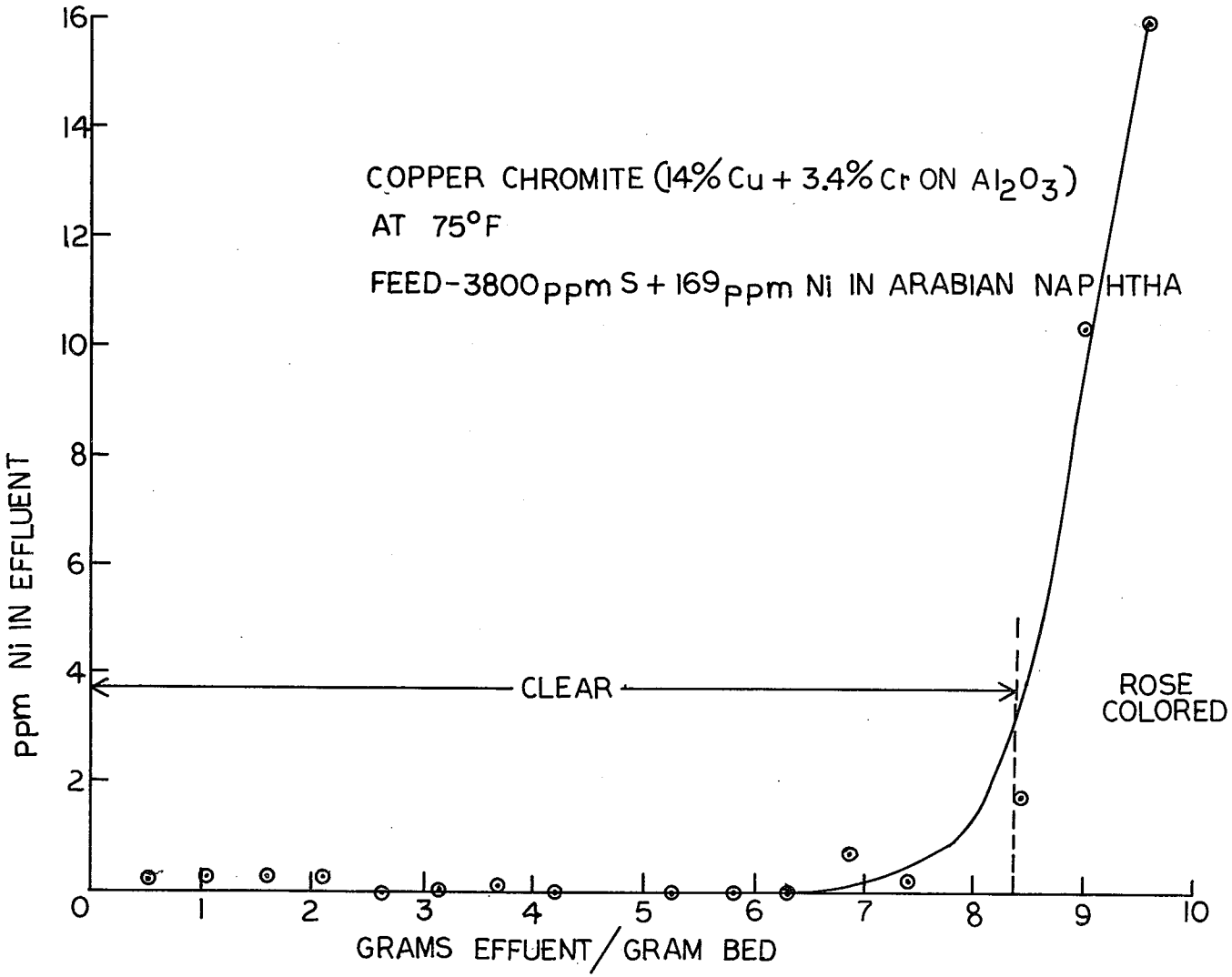
Figure 5:
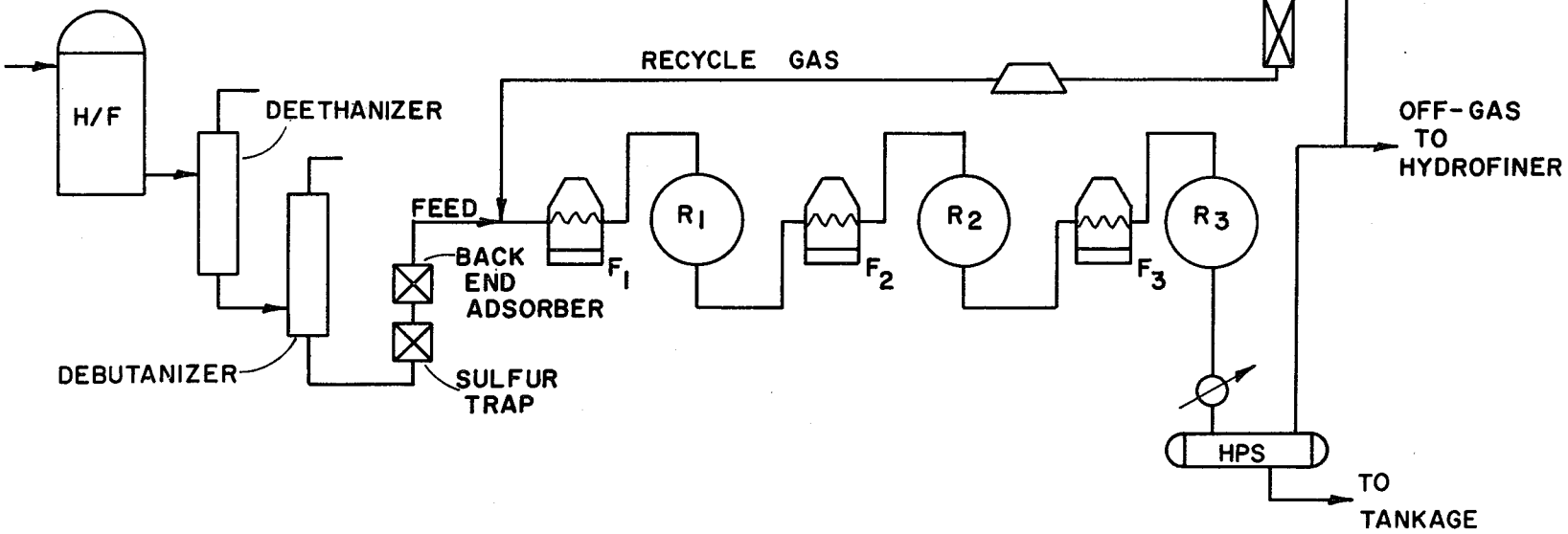

FIG. 1 shows the concentration of sulfur in the effluent from the column as a function of weight of effluent per weight of adsorbent. The amount of nickel removed is shown in FIG. 2. FIGS. 3 and 4 show results on sulfur and nickel removal, respectively. FIG. 5 depicts a hydrofiner, deethanizer, and debutanizer, a nickel catalyst containing sulfur trap, back-end guard bed downstream and in series therewith, and reformer unit the catalyst of which is protected by the combination of said nickel catalyst containing sulfur trap and back-end adsorber or guard bed.

THE INVENTION

In accordance with the present invention, a back-end guard bed is located downstream of and in series with the nickel catalyst-containing sulfur trap to remove the organosulfur nickel complex formed in the nickel catalyst-containing sulfur trap and passed along with the product therefrom during periods of hydrofiner upset, or such other periods when sulfur concentration, flow rate and operating temperature of the feed passed from the hydrofiner through the nickel catalyst-containing sulfur trap forms the organosulfur-nickel complex. Transition series metals such as those of Group I-B, II-B, VI-B, and VIII (Periodic Table of the Elements, E. H. Sargent & Co. 1962) either by themselves or supported on a high surface area refractory oxide such as alumina, silica gel, zeolite, bauxite, or activated carbon, are found particularly effective in removing the organosulfur nickel complex or the burgundy color from the effluent of the nickel sulfur trap. Preferably, transition series metals are such metals as Cu, Zn, Cr, Mo, Co, Fe and the like. When supported on a high surface area support, preferred concentrations lie in the range of 5% to 75% by weight when expressed as the metal oxide. Surprisingly, common adsorbents such as high surface area alumina, silica gel, activated carbon, and 13X molecular sieve are not particularly effective for removal of the organosulfur nickel complex or the burgundy color from the effluent of the nickel sulfur trap.

The invention will be more fully understood by reference to the following nonrestrictive examples showing the utility of certain metal compositions and also describing in some detail the overall process in which the guard bed of this invention is utilized.

EXAMPLE I

For testing, a burgundy colored, nickel containing naphtha was prepared by passage of a naphtha spiked with n-hexyl mercaptan over a massive nickel catalyst at 150° F. This material was passed through a packed bed of Co/Mo on alumina sized to 16–35 mesh (Tyler) at a temperature of 75° F. The inlet feed contained 2590 ppm S and 28 ppm nickel by weight. These concentrations are considerably in excess of those to be encountered in refinery operations and were employed herein in order to accelerate the testing time.

FIG. 1 shows the concentration of sulfur in the effluent from the column as a function of weight of effluent per weight of adsorbent. The amount of nickel removed is shown in FIG. 2. Clearly, as shown by these data, the adsorption catalyst is quite effective for removing both sulfur and nickel from the naphtha. In actual refinery practice, the sulfur and nickel content of the feed would usually be considerably lower on the order of 0.1–10 wppm; consequently, the life of the adsorbent would even be much longer than that indicated in these figures.

EXAMPLE II

In a separate experiment, another sample of burgundy colored organosulfur nickel complex containing naphtha was prepared by autoclaving a naphtha spiked with n-hexylmercaptan with a massive nickel catalyst at 150° F. and 275 psig. This material was passed through a packed bed of copper chromite dispersed on alumina and sized to 16–35 mesh. The experiment was conducted at 75° F. The inlet feed contained 3800 ppm S and 169 ppm Ni. FIGS. 3 and 4 show results on sulfur and nickel removal, respectively. Also, the effluent from the column was clear until nearly 8.5 weight of effluent per weight of adsorption catalyst was collected. The change in color corresponded with the presence of nickel in the effluent. Again, the potential for using this material as a guard bed to prevent nickel from contaminating the reforming catalyst is clearly evident.

The invention, and its method of operation will be more fully understood by reference to the following more detailed description, and FIG. 5 to which reference is made.

FIG. 5 depicts a hydrofiner, deethanizer, and debutanizer, a nickel catalyst containing sulfur trap, back-end guard bed downstream and in series therewith, and reformer unit the catalyst of which is protected by the combination of said nickel catalyst containing sulfur trap and back-end adsorber or guard bed.

Referring to FIG. 5, a hydrofined petroleum naphtha feed from hydrofiner H/F is passed serially through a deethanizer and a debutanizer, and the partially desulfurized feed from the debutanizer is passed through a nickel catalyst containing sulfur trap, and back-end guard bed. During normal operation the hydrofiner H/F removes sufficient of the feed sulfur to provide a product containing from about 1 ppm to about 5 ppm sulfur, generally from about 0.5 to about 2 ppm sulfur.

The sulfur trap generally contains a fixed bed of massive nickel catalyst, i.e., 10–70 wt. % Ni supported on alumina, silica-alumina, or crushed Kieselguhr. The nickel is highly dispersed, of high surface aea and pore volume. (Cu, Zn, or Mo may be added to the nickel). The low sulfur-containing feed (i.e., one containing about 1–50 ppm sulfur), generally boiling in the range of $C^5+$ to 430° F. is passed over the nickel catalyst. Sulfur from the feed, primarily in the form of mercaptans, thiophene, hydrogen sulfide, and the like, is chemically adsorbed on the nickel catalyst.

When the sulfur trap is operated at temperatures less than or approximating 200° F. and the sulfur concentration in the feed increases due to hydrofiner upset, the formation of a soluble organosulfur nickel complex occurs, the presence of which often produces a brown to purplish discoloration of the product. Passage of such product through the back-end guard bed, however, removes via adsorption or chemical reaction any organosulfur-nickel complex that may be present; thus protecting the catalyst of the reforming unit.

The protected reforming unit, to complete the description, is comprised of a multi-reactor system, three reactors being shown for convenience, viz. Reactors $R_1$, $R_2$, and $R_3$ each of which are connected in series and preceded by a heater or preheat furnace, $F_1$, $F_2$, and $F_3$, respectively. Pumps, compressors and other auxiliary equipment are omitted for clarity. The desulfurized feed, free of both nickel and sulfur component, is serially passed with hydrogen through $F_1R_1$, $F_2R_2$, and $F_3R_3$ with the products from the reactions being passed to a high pressure separator HPS. Each reactor is packed with fixed beds of a sulfur sensitive polymetallic platinum catalyst heretofore described, suitably a platinum-rhenium-alumina catalyst or a platinum iridium-alumina catalyst. A portion of the hydrogen-rich make gas can be taken from the top of the high pressure separator HPS and, after passage through a make gas compressor, recycled to the hydrofiner, H/F, and another portion recycled through gas driers to the lead furnace and reactor $F_1R_1$. Substantially all, or a major portion of the moisture and sulfur are scrubbed and removed from the recycle gas by the recycle gas drier loaded, e.g., with a zinc alumina spinel sorbent to maintain a dry, low-sulfur system. $C_5$+ liquids from the bottom of high pressure separator HPS are sent to a stabilizer, or to tankage.

It is apparent that various modifications and changes can be made without departing the spirit and scope of the invention.

Having described the invention, what is claimed is:

1. In a process which includes in combination a hydrofiner, sulfur trap, and reforming unit, a hydrofiner located upstream of the reforming unit, for hydrofining a sulfur-containing naphtha to remove a major portion of the sulfur and form a low-sulfur naphtha, a nickel catalyst-containing sulfur trap located downstream of said hydrofiner, the low-sulfur naphtha from the hydrofiner being passed therethrough and contacted with the nickel catalyst to remove sulfur from the naphtha, a reforming unit for reforming, with hydrogen, the low-sulfur naphtha from the hydrofiner and nickel-containing sulfur trap, the reforming unit containing a plurality of catalyst-containing on-stream reactors connected in series, the hydrogen and low-sulfur naphtha feed flowing from one reactor of the series to another to contact the catalyst contained therein at reforming conditions, the improvement comprising a guard bed, containing an adsorption catalyst, located downstream of said nickel ctalyst-containing sulfur trap, and up-stream of the on-stream reactors of the reforming unit, through which said naphtha is passed, whereby, when the sulfur concentration, flow rate and operating temperature of the naphtha feed entering said nickel catalyst-containing sulfur trap produce an organo-sulfur nickel complex which is dissolved within the naphtha, the organosulfur nickel complex formed in said nickel catalyst-containing sulfur trap is removed by the adsorption catalyst in said guard bed to suppress poisoning of the catalyst of the on-stream reactors of said reforming unit.

2. The process of claim 1 wherein the adsorption catalyst used in the guard bed is constituted of one or more metals or metal oxides of Group I-B, II-B, VI-B, and VIII of the Periodic Table.

3. The process of claim 2 wherein the metals or metal oxides are supported on a high surface area refractory oxide such as alumina, silica gels, zeolite, bauxite, or activated carbon.

4. The process of claim 2 wherein the metals or metal oxides are constituted of one or more of Cu, Zn, Cr, Mo, Co, or Fe.

5. The process of claim 1 wherein the sulfur trap contains a fixed bed of nickel catalyst highly dispersed and supported on alumina, silica-alumina, or crushed Kieselguhr.

* * * * *